US008240891B2

(12) United States Patent
Albert et al.

(10) Patent No.: US 8,240,891 B2
(45) Date of Patent: Aug. 14, 2012

(54) LAMP ARRANGEMENT MOUNTING SYSTEM FOR CABINETS

(75) Inventors: Sandor Albert, Breidenbach (DE); Horst Seibel, Breidenbach (DE)

(73) Assignee: Rittal GmbH & Co. KG, Herborn (DE)

( * ) Notice: Subject to any disclaimer, the term of this patent is extended or adjusted under 35 U.S.C. 154(b) by 555 days.

(21) Appl. No.: 12/225,645

(22) PCT Filed: Mar. 28, 2007

(86) PCT No.: PCT/EP2007/002748

§ 371 (c)(1),
(2), (4) Date: Sep. 26, 2008

(87) PCT Pub. No.: WO2007/112907

PCT Pub. Date: Oct. 11, 2007

(65) Prior Publication Data

US 2011/0075430 A1 Mar. 31, 2011

(30) Foreign Application Priority Data

Mar. 29, 2006 (DE) ..... 20 2006 005 151 U1
Jun. 29, 2006 (EP) ..... 06013449

(51) Int. Cl.
*F21V 23/04* (2006.01)
*F21V 21/096* (2006.01)
*A47B 97/00* (2006.01)

(52) U.S. Cl. ..... 362/394; 362/133; 362/249.12; 362/276; 362/398

(58) Field of Classification Search ..... 362/394, 362/395, 398, 249.05, 249.06, 249.12, 249.13, 362/249.14, 249.16, 276, 133
See application file for complete search history.

(56) References Cited

U.S. PATENT DOCUMENTS

| | | | | | |
|---|---|---|---|---|---|
| 2,411,100 | A * | 11/1946 | MacDonald | 362/394 |
| 5,154,509 | A * | 10/1992 | Wulfman et al. | 362/398 |
| 5,246,285 | A * | 9/1993 | Redburn et al. | 362/276 |
| 5,669,698 | A * | 9/1997 | Veldman et al. | 362/249.13 |
| 5,803,589 | A * | 9/1998 | Lee | 362/225 |
| 5,844,763 | A * | 12/1998 | Grace et al. | 361/111 |
| 5,911,524 | A * | 6/1999 | Wilton | 362/276 |
| 6,814,462 | B1 * | 11/2004 | Fiene | 362/133 |
| 6,964,504 | B2 * | 11/2005 | Newbold | 362/375 |
| 7,027,736 | B1 * | 4/2006 | Mier-Langner et al. | 362/249.13 |
| 7,431,482 | B1 * | 10/2008 | Morgan et al. | 362/364 |
| 2005/0174776 | A1 * | 8/2005 | Althaus | 362/276 |

FOREIGN PATENT DOCUMENTS

| | | | |
|---|---|---|---|
| DE | 70 10 524 | U | 11/1970 |
| DE | 197 10 291 | A1 | 9/1998 |
| DE | 20 2004 018923 | U1 | 3/2005 |

OTHER PUBLICATIONS

DE19710291Englishtranslation, machine translation to English by translationgateway.epo.org, 3 pages including description and claims.*

DE7010524Englishtranslation, machine translation to English by translationgateway.epo.org, 2 pages including description and claims.*

* cited by examiner

*Primary Examiner* — Alan Cariaso
(74) *Attorney, Agent, or Firm* — Pauley Petersen & Erickson

(57) ABSTRACT

A lamp arrangement with a lamp housing with at least one housing surface having at least one module connecting device, and at least one module set including at least two housing connecting modules. The housing connecting modules have a correspondingly configured connecting device for connection to the module connecting device.

26 Claims, 3 Drawing Sheets

LAMP ARRANGEMENT MOUNTING SYSTEM FOR CABINETS

BACKGROUND OF THE INVENTION

1. Field of the Invention

This invention relates to a lamp arrangement having a lamp housing with at least one module connecting device on at least one housing surface and having a module set with at least two housing connecting modules, the housing connecting modules each having a respective correspondingly configured connecting device for connection to the module connecting device.

2. Discussion of Related Art

Lamps known from the prior art are used for illuminating technical devices in switch cabinets, equipment cabinets, or cabinets of this kind. Usually, these lamps are mounted to the door of the cabinet, to the ceiling of the cabinet, or to a pattern of holes that is a component of the cabinet. The location of its attachment is selected in accordance with useful illumination of the technical components installed in the cabinet. Various fastening techniques are known, for example detent connections, screw connections, or magnetic securing connections. The lamps for switch cabinets have a fastening technique that is adapted to one type of switch cabinet, such as screw connections that are matched to a hole pattern.

German Patent Reference DE 20 2004 018 923 U1 discloses a switch cabinet with an electrical lamp, a lamp with a lamp housing, illuminating means, electrical function elements, and connection elements mounted in the cabinet by being inserted into a cavity between profile sections of a profile strip, adapted in shape to the cavity, and fastened to the profile sections, with the front side of the lamp closing the cavity between the profile sections. In this case, the fastening devices are not interchangeable because they are embodied on the lamp housing and the lamp housing does not have modular connecting devices for housing connecting modules with a fastening device. Thus, it is not possible to easily fasten these lamps into a switch cabinet using different fastening techniques.

It is also known from the prior art that lamps of this kind can be functionally combined with technical function elements such as door switches, in order to trigger a lamp to automatically switch on when the door is opened. Thus, it may be necessary to use different fastening techniques for mounting the lamp and the function element, resulting in an increased installation cost.

SUMMARY OF THE INVENTION

One object of this invention is to provide a lamp that is simple to install and can be easily adapted to various fastening techniques in switch cabinets or equipment cabinets and which includes a lamp arrangement with different fastening techniques and function elements.

This object is attained by a lamp arrangement with a lamp arrangement having characteristics described in this specification and in the claims.

The lamp arrangement according to this invention has a lamp housing with at least one module connecting device on at least one housing surface, and has a module set including at least two housing connecting modules, the housing connecting modules each having a respective correspondingly configured connecting device for connection to the module connecting device. If the corresponding configuration of the connecting device of the housing connecting module for connection to the module connecting device of the lamp housing, then differently embodied housing connecting modules can be adapted to the lamp housing in accordance with the fastening task.

A connection between the connecting device of the housing connecting module and the module connecting device can be detachable.

To fasten the lamp housing, at least one housing connection module of the module set can have a fastening device for fastening to a fastening base. This makes it possible to install the lamp housing with housing connecting modules in a conventional switch cabinet with fastening devices adapted to the switch cabinet.

If a switch cabinet does not have a hole pattern for the attachment of the lamp housing, the fastening device can be in the form of a magnet, which permits a flexible fastening of the lamp to a magnetically effective surface. In order to assure a particularly stable attachment of the lamp, the fastening device can be embodied in the form of a tab with at least one through opening and that permits a screw connection to a fastening base. In addition, the fastening device can be in the form of a detent element, which permits an attachment of the lamp through a detent engagement in a hole pattern of the switch cabinet.

In one embodiment of the lamp arrangement, at least one housing connecting module has a connecting device in the form of a detent element. This permits a simple, rapid attachment of the housing connecting module to the lamp housing. In another embodiment of the connection of the housing connecting module and the lamp housing, a module connecting device is of a recess in the lamp housing and has undercuts on at least one side surface. A module connecting device makes it possible to insert or snap the housing connecting module into the module connecting device, thus rapidly equipping the lamp housing with the respective housing connecting modules as required.

The lamp arrangement according to this invention can include at least one housing connecting module that has a function element suitable for influencing the operating state of the lamp. In addition, the housing connecting module can have a housing. In one embodiment, the housing connecting module, which is of a function element and a housing, can have a connecting device in the form of an electrical connecting element with at least one electrical conductor. A connecting device thus embodied makes it possible to connect a function element to the lamp housing by the module connecting device.

In other advantageous embodiments, the function element can be in the form of a mechanical door switch, a motion sensor, or a photoelectric switch; in all of the embodiments, the function element executes a function control of the lamp when a cabinet door is opened or closed.

BRIEF DESCRIPTION OF THE DRAWINGS

This invention is described in greater detail in view of the accompanying drawings, wherein.

DETAILED DESCRIPTION OF THE INVENTION

Figure 1:
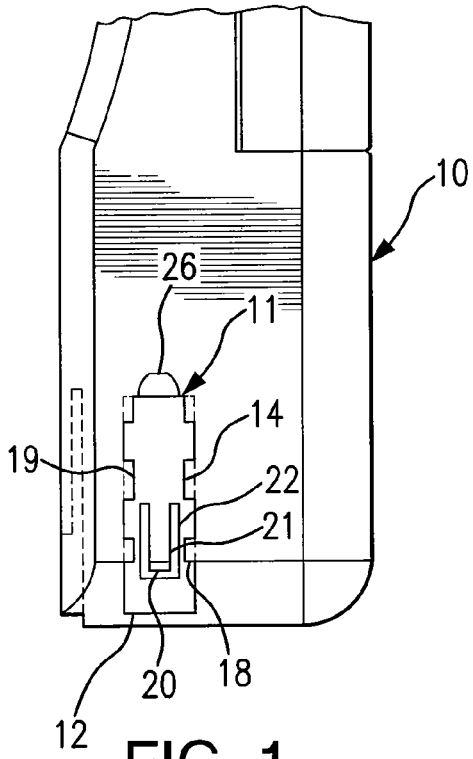
FIGS. 1 through 3 each shows a different view of a lamp housing.
Figure 2:
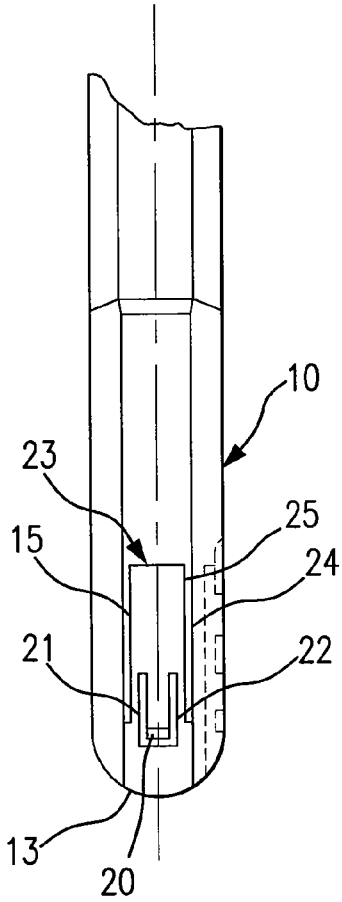
Figure 3:
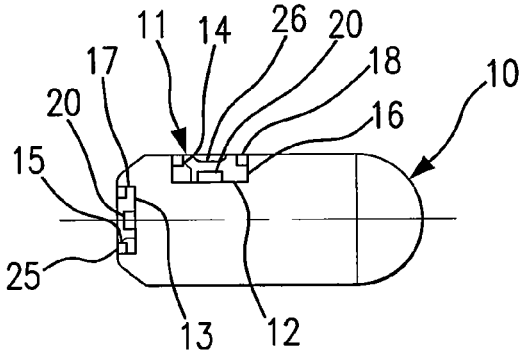

FIGS. 1 through 3 show various views of a lamp housing 10, with module connecting devices 11 and 23, which have a recess 12, 13 in the lamp housing 10. The recesses 12 and 13 in the lamp housing 10 have undercuts 16 and 17 on their side surfaces 14 and 15; the undercuts 16 and 17 are in a form of slots. The undercut 16, together with the side surface 14, forms a rib 18 that is of partial pieces 19 spaced apart from one another. The module connecting devices 11 and 23 in the lamp housing 10 also have a detent projection 20 situated at the end of a leaf spring 21 that is formed by a U-shaped cutout 22 in the lamp housing 10.

FIG. 2 shows the module connecting device 23 situated on the underside of the lamp housing 10 and having the recess 13. A rib 25 of an undercut 24 is embodied as complete or uninterrupted over its entire length. In order to permit easy removal of housing connecting modules from the module connecting device 11, the recess 12 can also have a semicircular, concave recess 26, as shown in FIGS. 1 and 3.

Figure 4:
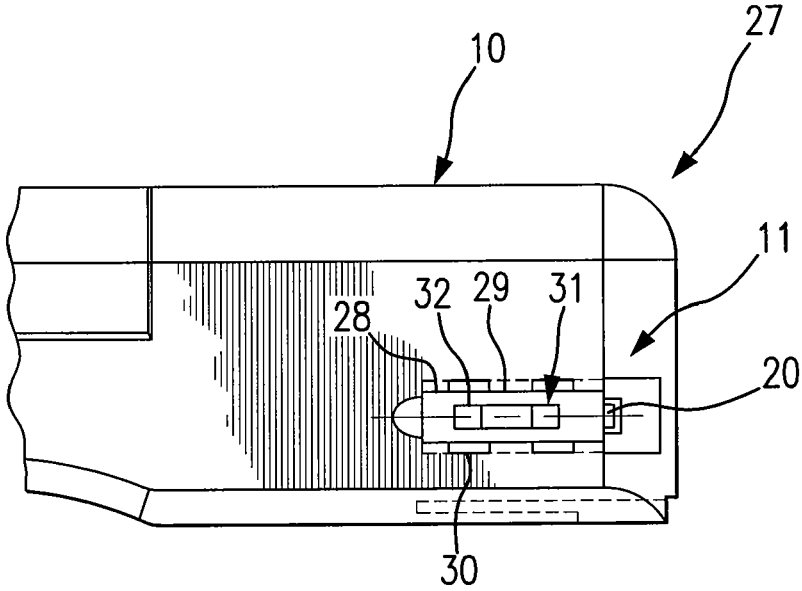
FIG. 4 shows a lamp arrangement, with a first embodiment of a housing connecting module.

FIG. 4 shows a lamp arrangement 27 with a lamp housing 10, a module connecting device 11, and a housing connecting module 28, which is inserted into the module connecting device 11. The housing connecting module 28 has a connecting device 29 with ribs 30 that correspond to the module connecting device 11, and thus fits in a form-locked fashion into the module connecting device 11. The detent projection 20 prevents the connecting device 29, which is of plastic, from slipping out from the module connecting device 11. In the embodiment shown, the housing connecting module 28 has a fastening device 31 comprising a detent element 32. The detent element 32 can, for example, be of spring steel or plastic and, in order to produce a connection with a hole pattern, can be embodied so that it corresponds to the through openings of the hole pattern.

Figure 5:
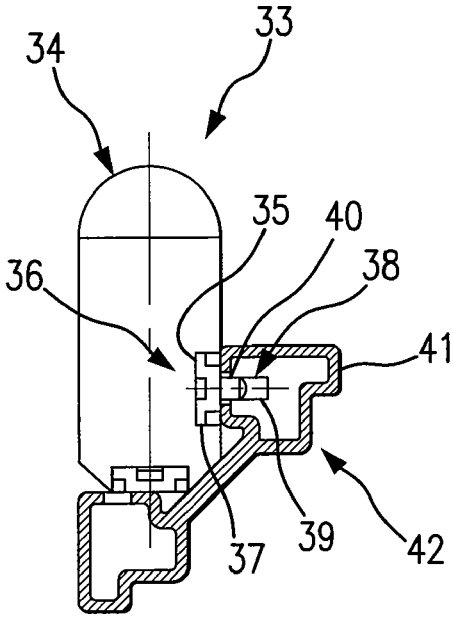
FIG. 5 shows a lamp arrangement, with the first embodiment of the housing connecting module as shown in FIG. 4 but with its attachment to a fastening base.

FIG. 5 shows a lamp arrangement 33, including a lamp housing 34 and a module connecting device 35 into which a housing connecting module 36 with a connecting device 37 and a fastening device 38 is inserted. The fastening device 38 can have a detent element 39 that is inserted into a through opening 40 in a profile section 41 of a fastening base 42.

Figure 6:
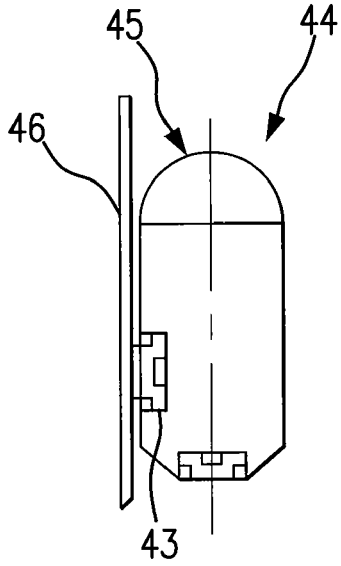
FIG. 6 shows a lamp arrangement, with a second embodiment of a housing connecting module and its attachment to a fastening base.

The embodiment form of a housing connecting module 43 of a lamp arrangement 44 depicted in FIG. 6 shows that the housing connecting module 43 is of a magnetic material which is suitable for fixing a lamp housing 45 to a fastening base 46. The fastening base 46 in this case can be of a magnetically effective material, such as a sheet steel.

Figure 7:
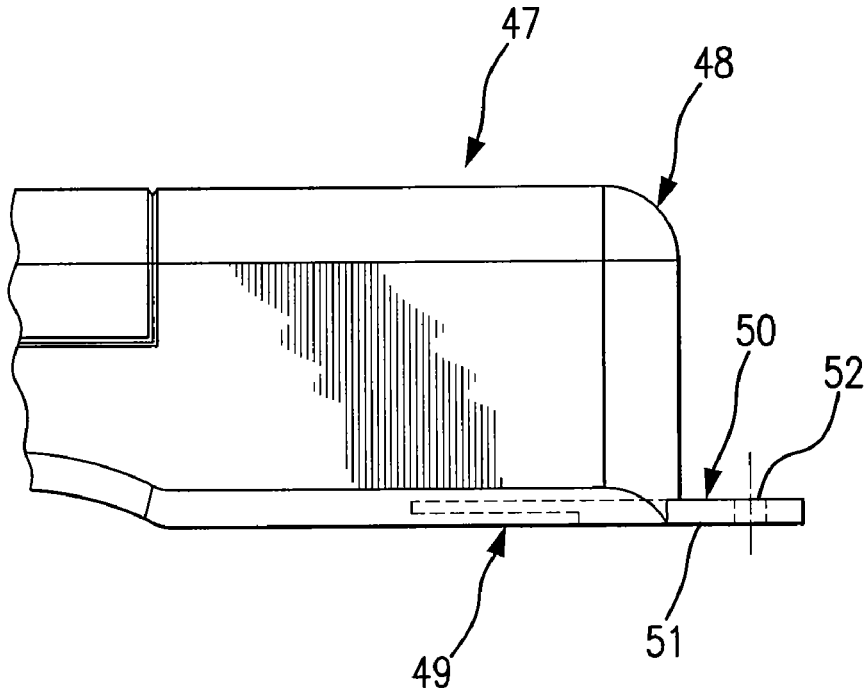
FIG. 7 shows a lamp arrangement, with a third embodiment of a housing connecting module.

Another fastening alternative is shown by FIG. 7, in which a lamp arrangement 47 with a lamp housing 48 and a module connecting device 49 is shown, into which a housing connecting module 50 is inserted, which is in the form of a tab 51 equipped with a through opening 52. With the tab 51 and through the use of a fastening means such as the screw, the lamp housing 48 can be fastened to a fastening base such as a hole pattern of a switch cabinet.

Figure 8:
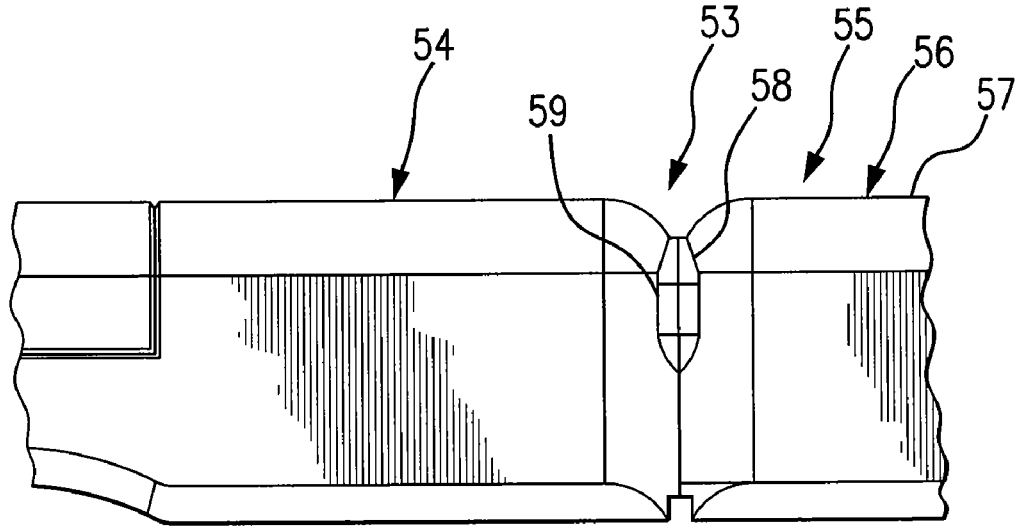
FIG. 8 shows a lamp arrangement, with a fourth embodiment of a housing connecting module.

FIG. 8 shows a lamp arrangement 53 that has a lamp housing 54 and a housing connecting module 55. The housing connecting module 55 includes a function element 56 that has a housing 57 and that is connected by a connecting device 58 to a module connecting device 59 of the lamp housing 54. The corresponding connection of the module connecting device 59 and the connecting device 58 can be embodied as a connection with at least one electrical conductor. The lamp housing 54 can also be fastened to a fastening base in a suitable fashion through the use of other housing connecting modules not shown in FIG. 8.

Other embodiments of a lamp arrangement are produced if a connecting device is of a cable with at least one electrical conductor that is routed out from a housing of a function element. Thus, the function element must be fastened to a fastening location other than the fastening location of the lamp housing. This is particularly advantageous especially when the function element is a mechanical door switch that must be fastened in the immediate vicinity of a switch cabinet door. Alternatively, the function element can have a motion sensor or a photoelectric switch, which registers movements or a change in lighting when a switch cabinet door is opened and triggers a lamp, in a corresponding fashion.

The invention claimed is:

1. A lamp arrangement (27, 33, 44, 47, 53) for a cabinet, comprising:

a lamp housing (10, 34, 45, 48, 54) with a module connecting device (11, 23, 35, 49, 59) on a housing surface; and a module set including at least two interchangeable housing connecting modules (28, 36, 43, 50, 55), the housing connecting modules (28, 36, 43, 50, 55) each including a correspondingly configured connecting device (29, 37, 58) for a detachable connection to the module connecting device (11, 23, 35, 49, 59), and the housing connecting modules (28, 36, 43, 50, 55) each including a fastening device (31, 38) for fastening the lamp housing to a fastening base (42, 46) of the cabinet;

wherein the at least two interchangeable housing connecting modules include a first housing connecting module with a first fastening device and a second housing connecting module with a second fastening device, the second fastening device providing a different type of fastening base connection from the first fastening device, and the first fastening device is embodied for connection to a first fastening base including through openings of a hole pattern provided in a profiled section, and the second fastening device is embodied for connection to a second and different type of fastening base of the cabinet.

2. The lamp arrangement as recited in claim 1, wherein the second fastening device (31, 38) is in a form of a magnet.

3. The lamp arrangement as recited in claim 1, wherein the fastening device (31, 38) is formed as a tab (51) with at least one through opening (52).

4. The lamp arrangement as recited in claim 1, wherein the fastening device (31, 38) is formed as a detent element (32, 39).

5. The lamp arrangement as recited in claim 4, wherein at least one of the respective correspondingly configured connecting device (29, 37, 58) is formed as a detent element.

6. The lamp arrangement as recited in claim 5, wherein the module connecting device (11, 23, 35, 49, 59) has a recess (12, 13) in the lamp housing (10, 34, 45, 48, 54) with an undercut (16, 17) on at least one side surface (14, 15).

7. The lamp arrangement as recited in claim 6, wherein the housing connecting module (28, 36, 43, 50, 55) is insertable or snappable into the module connecting device (11, 23, 35, 49, 59).

8. The lamp arrangement as recited in claim 7, wherein at least one housing connecting module (55) has a function element (56) for influencing an operating state of the lamp arrangement.

9. The lamp arrangement as recited in claim 8, wherein the function element (56) is formed as a mechanical door switch.

10. The lamp arrangement as recited in claim 8, wherein the function element (56) is formed as a motion sensor.

11. The lamp arrangement as recited in claim 8, wherein the function element (56) is formed as a photoelectric switch.

12. The lamp arrangement as recited in claim 8, wherein the housing connecting module (55) has a housing (57).

13. The lamp arrangement as recited in claim 12, wherein the correspondingly configured connecting device (58) of the housing connecting module (55) is formed as an electrical connecting element with at least one electrical conductor.

14. The lamp arrangement as recited in claim 13, wherein the function element (56) is formed as a mechanical door switch.

15. The lamp arrangement as recited in claim 13, wherein the function element (56) is formed as a motion sensor.

16. The lamp arrangement as recited in claim 13, wherein the function element (56) is formed as a photoelectric switch.

17. The lamp arrangement as recited in claim 1, wherein the at least one housing connecting module (28, 36, 43, 50, 55) has a fastening device (31, 38) for fastening to a fastening base (42, 46).

18. The lamp arrangement as recited in claim 1, wherein a fastening device (31, 38) is in a form of a magnet.

19. The lamp arrangement as recited in claim 1, wherein a fastening device (31, 38) is formed as a tab (51) with at least one through opening (52).

20. The lamp arrangement as recited in claim 1, wherein a fastening device (31, 38) is formed as a detent element (32, 39).

21. The lamp arrangement as recited in claim 1, wherein at least one of the respective correspondingly configured connecting device (29, 37, 58) is formed as a detent element.

22. The lamp arrangement as recited in claim 1, wherein the module connecting device (11, 23, 35, 49, 59) has a recess (12, 13) in the lamp housing (10, 34, 45, 48, 54) with an undercut (16, 17) on at least one side surface (14, 15).

23. The lamp arrangement as recited in claim 1, wherein the housing connecting module (28, 36, 43, 50, 55) is insertable or snappable into the module connecting device (11, 23, 35, 49, 59).

24. The lamp arrangement as recited in claim 1, wherein at least one housing connecting module (55) has a function element (56) for influencing an operating state of the lamp arrangement.

25. The lamp arrangement as recited in claim 24, wherein the housing connecting module (55) has a housing (57).

26. The lamp arrangement as recited in claim 25, wherein the housing connecting module (55) has a connecting device (58) formed as an electrical connecting element with at least one electrical conductor.

* * * * *